US010760172B2

(12) United States Patent
Sato et al.

(10) Patent No.: US 10,760,172 B2
(45) Date of Patent: Sep. 1, 2020

(54) FILM FORMING METHOD FOR METAL FILM AND FILM FORMING APPARATUS THEREFOR

(71) Applicant: TOYOTA JIDOSHA KABUSHIKI KAISHA, Toyota-shi, Aichi-ken (JP)

(72) Inventors: Yuki Sato, Nagoya (JP); Motoki Hiraoka, Toyota (JP); Hirofumi Iisaka, Nagoya (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 16/395,544

(22) Filed: Apr. 26, 2019

(65) Prior Publication Data

US 2019/0249321 A1 Aug. 15, 2019

Related U.S. Application Data

(62) Division of application No. 15/597,811, filed on May 17, 2017, now Pat. No. 10,337,116.

(30) Foreign Application Priority Data

May 23, 2016 (JP) ..... 2016-102703

(51) Int. Cl.
*C25D 3/00* (2006.01)
*C25D 5/06* (2006.01)
(Continued)

(52) U.S. Cl.
CPC ..... *C25D 3/00* (2013.01); *C25D 5/06* (2013.01); *C25D 17/004* (2013.01);
(Continued)

(58) Field of Classification Search
CPC ..... C25D 17/06
See application file for complete search history.

(56) References Cited

U.S. PATENT DOCUMENTS

2002/0151257 A1 10/2002 Basol et al.
2008/0066862 A1 3/2008 Gunji et al.
(Continued)

FOREIGN PATENT DOCUMENTS

CN 204550740 U 8/2015
JP 6-116796 A 4/1994
(Continued)

OTHER PUBLICATIONS

Li, Machine Translation, CN 204550740 U (Year: 2015).
Sato, Machine Translation, JP 2014-051701 A (Year: 2014).

*Primary Examiner* — James Lin
*Assistant Examiner* — Ho-Sung Chung
(74) *Attorney, Agent, or Firm* — Sughrue Mion, PLLC

(57) ABSTRACT

In a film forming method, in a state where a metal solution is sealed in a first accommodation chamber of a housing with a solid electrolyte membrane and a fluid is sealed in a second accommodation chamber of a placing table with a thin film, a substrate is placed on the placing table and the placing table and the housing are moved relative to each other to cause the substrate to be interposed between the solid electrolyte membrane and the thin film, the solid electrolyte membrane and the thin film are pressed against the substrate interposed therebetween to cause the solid electrolyte membrane and the thin film to conform to a surface and a rear surface of the substrate, thereby forming a metal film.

3 Claims, 6 Drawing Sheets

(51) Int. Cl.

| | |
|---|---|
| ***C25D 17/00*** | (2006.01) |
| ***C25D 17/06*** | (2006.01) |
| ***C25D 17/14*** | (2006.01) |
| ***C25D 3/38*** | (2006.01) |

(52) U.S. Cl.
CPC ..... *C25D 17/005* (2013.01); *C25D 17/06* (2013.01); *C25D 17/14* (2013.01); *C25D 3/38* (2013.01)

(56) References Cited

U.S. PATENT DOCUMENTS

| | | | |
|---|---|---|---|
| 2012/0318666 | A1 | 12/2012 | Basker et al. |
| 2015/0329982 | A1 | 11/2015 | Miura et al. |
| 2016/0265129 | A1 | 9/2016 | Hiraoka et al. |
| 2017/0047237 | A1 | 2/2017 | Kobata et al. |
| 2017/0335479 | A1 | 11/2017 | Sato et al. |

FOREIGN PATENT DOCUMENTS

| | | | |
|---|---|---|---|
| JP | 11-100691 | A | 4/1999 |
| JP | 2014-051701 | A | 3/2014 |
| JP | 2015218366 | A | 12/2015 |
| TW | 201606871 | A | 2/2016 |
| WO | 2015/072481 | A1 | 5/2015 |

FILM FORMING METHOD FOR METAL FILM AND FILM FORMING APPARATUS THEREFOR

INCORPORATION BY REFERENCE

This is a divisional of U.S. application Ser. No. 15/597,811 filed May 17, 2017 (allowed), which claims priority to Japanese Patent Application No. 2016-102703 filed on May 23, 2016, the disclosure of which, including the specification, drawings and abstract, is incorporated herein by reference in its entirety.

BACKGROUND

1. Technical Field

The present disclosure relates to a film forming method of forming a metal film on the surface of a substrate, and a film forming apparatus therefor, and more particularly to a film forming apparatus for a metal film capable of forming a metal film on the surface of a substrate by applying a voltage between an anode and a substrate.

2. Description of Related Art

A technique for forming a metal film by causing a metal to deposit on the surface of a substrate has been proposed. As such a technique, for example, Japanese Patent Application Publication No. 2014-051701 (JP 2014-051701 A) proposes a film forming apparatus for a metal film including an anode, a solid electrolyte membrane disposed between the anode and a substrate which is a cathode, a power supply which applies a voltage between the anode and the substrate, and a placing table on which the substrate is placed. The film forming apparatus includes a solution accommodation portion which accommodates a metal solution containing metal ions between the anode and the solid electrolyte membrane and a pressurizing portion which pressurizes the metal solution in the solution accommodation portion.

According to the film forming apparatus, the solid electrolyte membrane is pressurized by the liquid pressure of the metal solution pressurized by the pressurizing portion, and the surface of the substrate is pressed by the pressurized solid electrolyte membrane. Accordingly, the solid electrolyte membrane conforms to the surface of the substrate. The metal ions contained in the solid electrolyte membrane are reduced at the surface of the substrate by applying a voltage between the anode and the substrate, thereby forming a uniform metal film on the surface of the substrate.

SUMMARY

However, in the film forming apparatus according to JP 2014-051701 A, when the substrate is pressed by the solid electrolyte membrane, the substrate is interposed between the solid electrolyte membrane and the placing table. At this time, in a case where the substrate undergoes warping or undulation, a gap may be formed between the placing table and the substrate during film formation. Due to the gap, the reaction force from the placing table is not uniformly exerted on the rear surface of the substrate when the substrate is pressed by the solid electrolyte membrane. As a result, there is a possibility that the solid electrolyte membrane may not be uniformly pressed against the surface of the substrate, and a metal film having a uniform thickness may not be formed.

The present disclosure provides a film forming method for a metal film and a film forming apparatus therefor capable of forming a metal film having a uniform film thickness on the surface of a substrate by uniformly pressing a solid electrolyte membrane against the surface of the substrate.

According to a first aspect of the present disclosure, there is provided a method for forming a metal film on a surface of a substrate by disposing a solid electrolyte membrane between an anode and the substrate which is a cathode and applying a voltage between the anode and the substrate in a state in which the solid electrolyte membrane is brought into contact with the surface of the substrate placed on a placing table so as to cause metal ions contained in the solid electrolyte membrane to be reduced and cause a metal derived from the metal ions to deposit on the surface of the substrate.

In the first aspect, a metal solution containing the metal ions is disposed between the anode and the solid electrolyte membrane, and the metal solution is caused to be in a state of being sealed in a first accommodation chamber of a housing with the solid electrolyte membrane so as to cause the metal solution to be disposed on the surface of the substrate via the solid electrolyte membrane. Furthermore, a fluid is caused to be in a state of being sealed in a second accommodation chamber of the placing table with a thin film so as to cause the fluid to be disposed on a rear surface of the substrate positioned on a side opposite to the surface on which a metal film is formed, via the thin film having flexibility.

In order to form the metal film, the substrate is caused to be interposed between the solid electrolyte membrane and the thin film by moving the placing table and the housing relative to each other in a state in which the substrate is placed on the placing table, and the solid electrolyte membrane and the thin film are pressed against the substrate interposed therebetween to cause the solid electrolyte membrane and the thin film to conform to the surface and the rear surface of the substrate, thereby forming the metal film.

In the first aspect, the solid electrolyte membrane and the thin film may be pressed by increasing a pressure of the metal solution in the first accommodation chamber or a pressure of the fluid in the second accommodation chamber.

The first aspect may include restricting relative displacement between the housing and the placing table in the state in which the substrate is interposed between the solid electrolyte membrane and the thin film, wherein the metal film may be formed while pressing the solid electrolyte membrane and the thin film in the state in which the displacement is restricted.

In the first aspect, a plurality of first conductor portions on which the metal film is formed may be formed on the surface of the substrate, second conductor portions electrically connected to the first conductor portions may be formed on the rear surface of the substrate or a side surface of the substrate, a thin film in which a surface on which the substrate is placed has conductivity may be used as the thin film, the thin film may be brought into contact with the second conductor portion by pressing the thin film against the rear surface of the substrate, and the metal film may be formed on the first conductor portions by applying the voltage between the thin film and the anode.

In the first aspect, recesses may be formed on the rear surface of the substrate, and the second conductor portions may be formed at bottom surfaces of the recesses.

According to a second aspect of the present disclosure, there is provided a film forming apparatus for a metal film, which includes: an anode; a solid electrolyte membrane which is disposed between the anode and a substrate which is a cathode, and contains metal ions; a power supply which applies a voltage between the anode and the substrate; and a placing table on which the substrate is placed, in which by causing a metal derived from the metal ions to deposit on a surface of the substrate which is in contact with the solid electrolyte membrane, a metal film is formed on the surface of the substrate.

The film forming apparatus further includes a housing having a first accommodation chamber which accommodates a metal solution containing metal ions, the metal solution is disposed between the anode and the solid electrolyte membrane, the metal solution is sealed in the first accommodation chamber with the solid electrolyte membrane so as to cause the metal solution to be disposed on the surface of the substrate via the solid electrolyte membrane, a second accommodation chamber which accommodates a fluid is formed in the placing table, and the fluid is sealed in the second accommodation chamber with a thin film so as to cause the fluid to be disposed on a rear surface of the substrate positioned on a side opposite to the surface on which the metal film is formed, via the thin film having flexibility.

At least one of the housing and the placing table is movable to cause the substrate to be interposed between the solid electrolyte membrane and the thin film, and the film forming apparatus further includes a pressing portion which presses the solid electrolyte membrane and the thin film against the substrate in a state of being interposed between the solid electrolyte membrane and the thin film.

In the second aspect, the pressing portion may be a pump which pressurizes the metal solution in the first accommodation chamber or a pump which pressurizes the fluid in the second accommodation chamber.

The second aspect may include a restricting section which restricts relative displacement between the housing and the placing table in the state in which the substrate is interposed between the solid electrolyte membrane and the thin film.

In the second aspect, the thin film may be a thin film in which a surface on which the substrate is placed has conductivity.

According to the film forming method and the film forming apparatus according to the present disclosure, when the metal film is formed, the solid electrolyte membrane and the thin film conform to the surface and the rear surface of the substrate, the surface of the substrate is uniformly pressurized by the metal solution via the solid electrolyte membrane, and the rear surface of the substrate is uniformly pressurized by the fluid via the thin film. In this state, by applying a voltage between the anode and the substrate, the metal ions contained in the solid electrolyte membrane are reduced, the metal derived from the metal ions is deposited on the surface of the substrate, and a metal film having a uniform film thickness can be formed on the surface of the substrate.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Hereinafter, embodiments of the present disclosure will be described with reference to FIGS. 1A to 4E.

1. Film Forming Apparatus 1A

Figure 1A:
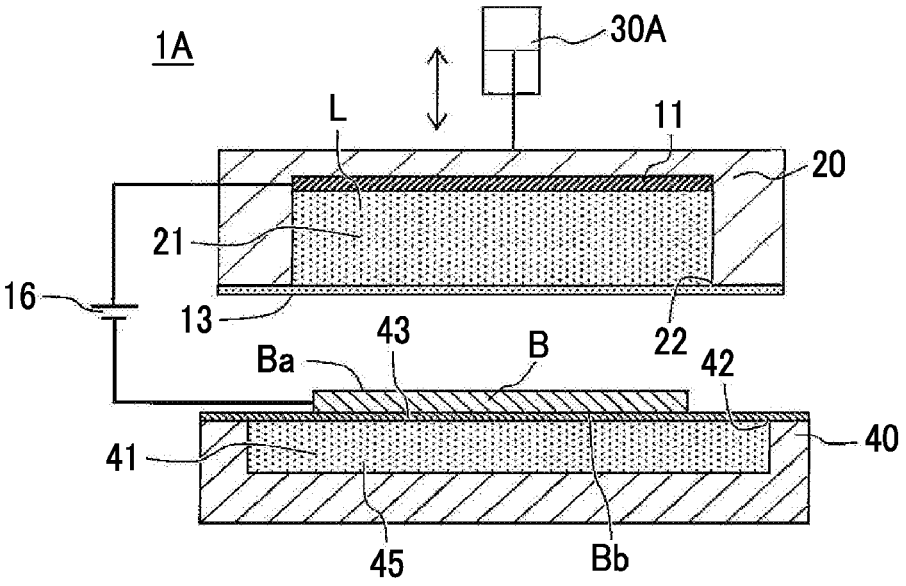
FIG. 1A is a schematic sectional view of a film forming apparatus for a metal film according to a first embodiment.

FIG. 1A is a schematic sectional view of a film forming apparatus 1A for a metal film according to a first embodiment of the present disclosure. The film forming apparatus 1A according to this embodiment is an apparatus that causes metal ions to be reduced so that a metal is deposited and a metal film from the deposited metal is formed on the surface of a substrate B.

The substrate B is not particularly limited as long as the surface on which the film is formed functions as a cathode (that is, a surface having conductivity). In this embodiment, the substrate B is a metal plate made of aluminum, iron, or the like. Alternatively, the substrate B may be a substrate in which the entirety or a part of the surface made of a polymer resin such as an epoxy resin or ceramics is coated with a metal layer made of copper, nickel, silver, iron, or the like, and the metal layer functions as a cathode.

The film forming apparatus 1A includes a anode 11 made of a metal, a solid electrolyte membrane 13 disposed between the anode 11 and the substrate B (cathode), a power supply 16 which applies a voltage between the anode 11 and the substrate B, and a placing table 40 on which the substrate B is placed.

The anode 11 may be in the form of a block or a flat plate or may be made of a porous body or a mesh (mesh-like member) as long as the anode 11 has a size that covers a region where the substrate B is formed. The material of the anode 11 is the same as the material of a metal film to be formed, and is preferably an anode which is soluble in a metal solution L containing metal ions, which will be described later. Accordingly, the deposition rate of the metal film can be increased. For example, in a case where the metal film is a copper film, it is preferable to use an oxygen-free copper plate as the material of the anode 11. Since the metal solution L before film formation contains metal ions, the anode 11 may also be an anode which is insoluble in the metal solution L.

The solid electrolyte membrane 13 can be impregnated with (contain) the metal ions by being brought into contact with the metal solution L and is not particularly limited as long as the metal ions are reduced at the surface of the substrate B and a metal derived from the metal ions are deposited when a voltage is applied. In this embodiment, the solid electrolyte membrane 13 has flexibility and has a film thickness and a hardness to conform to a surface Ba of the substrate B when pressed during film formation.

The film thickness of the solid electrolyte membrane 13 is preferably 100 to 200 μm. Examples of the material of the solid electrolyte membrane include a fluorine-based resin such as NAFION (registered trademark) manufactured by DuPont, a hydrocarbon-based resin, a polyamic acid resin, and a resin having a cation-exchange function such as SELEMION (CMV, CMD, and CMF series) manufactured by Asahi Glass Co., Ltd.

The metal solution L is a liquid (electrolyte solution) containing the metal of the metal film to be formed in the state of ions as described above. As the metal, for example, at least one or two or more selected from the group consisting of nickel, zinc, copper, chromium, tin, silver, and lead may be used. The metal solution L is an aqueous solution obtained by dissolving (ionizing) the metal with an acid such as nitric acid, phosphoric acid, succinic acid, nickel sulfate, or pyrophosphoric acid.

In this embodiment, the film forming apparatus 1A further includes a housing 20. In the housing 20, the metal solution L is disposed between the anode 11 and the solid electrolyte membrane 13, and a first accommodation chamber 21 which accommodates the metal solution L to cause the metal solution L to be disposed on the surface Ba of the substrate B via the metal solution L during film formation is formed.

In the first accommodation chamber 21, the anode 11 is disposed at a position opposing the solid electrolyte membrane 13, and the metal solution L accommodated in the first accommodation chamber 21 is in contact with the solid electrolyte membrane 13 and the anode 11. In the first accommodation chamber 21, a first opening 22 which has a size greater than that of the surface Ba of the substrate B on a side where the metal film is to be formed is formed. In the first accommodation chamber 21, the first opening 22 is covered with the solid electrolyte membrane 13 in the state in which the metal solution L is accommodated between the anode 11 and the solid electrolyte membrane 13, and the metal solution L is sealed in the first accommodation chamber 21 in a flowing state.

As described above, in this embodiment, during film formation, the metal solution L is disposed on the surface Ba of the substrate B via the solid electrolyte membrane 13, and the solid electrolyte membrane 13 conforms to the surface Ba of the substrate B by the liquid pressure of the metal solution L. As the material of the housing 20, a metal material such as aluminum or stainless steel or the like may be employed, and the material thereof is not particularly limited as long as the housing 20 is not excessively deformed (rigid body) by a pressing portion 30A.

In this embodiment, the film forming apparatus 1A is provided with the placing table 40 made of a metal, on which the substrate B is placed. The material of the placing table 40 is a metal material such as aluminum or stainless steel. However, the material thereof is not particularly limited as long as the placing table 40 is not excessively deformed (rigid body) by the pressing portion 30A.

In the placing table 40, a second accommodation chamber 41 which accommodates a fluid 45 to cause the fluid 45 to be disposed on the rear surface Bb of the substrate B positioned on the side opposite to the surface Ba on which the metal film is formed via a thin film 43 is formed. Specifically, in the second accommodation chamber 41, a second opening 42 which has a size greater than that of the rear surface Bb of the substrate B is formed. By covering the second opening 42 with the thin film 43 (film) the fluid 45 is sealed in the second accommodation chamber 41 in a flowing state.

Here, the fluid 45 is a material having fluidity, for example, a gas, a liquid, or a gel, and is not particularly limited as long as the material has a property of being cushioned from the substrate B when coming into contact with the substrate B via the thin film 43. For example, the gas includes air and an inert gas such as nitrogen gas. The liquid includes water and an oil. The gel includes a polymer gel such as polystyrene.

In this embodiment, the material of the thin film 43 includes a resin, a metal, or a laminate of these materials in a layer form, and the thin film 43 has flexibility. In this embodiment, the material and the thickness of the thin film 43 are not limited as long as the thin film 43 conforms to the rear surface Bb of the substrate B when pressed during film formation and the strength thereof is secured when pressed. The film thickness of the thin film 43 is preferably in a range of 0.1 to 10 μm.

The negative electrode of the power supply 16 is connected to the substrate B, and the positive electrode of the power supply 16 is connected to the anode 11. In a case where a metal layer is formed as the cathode on a part of the surface Ba of the substrate B, the metal layer is electrically connected to the negative electrode of the power supply 16, for example, via a conductor jig (not illustrated).

In this embodiment, the film forming apparatus 1A further includes the pressing portion 30A above the housing 20. In this embodiment, the housing 20 is movable (can be raised or lowered) by the pressing portion 30A so that the substrate B can be interposed between the solid electrolyte membrane 13 and the thin film 43. In this embodiment, the pressing portion 30A has (1) a function of moving (raising or lowering) the housing 20 with respect to the placing table 40 to cause the substrate B to be interposed between the solid electrolyte membrane 13 and the thin film 43, and (2) a function of pressing the solid electrolyte membrane 13 and the thin film 43 against the substrate B interposed between the solid electrolyte membrane 13 and the thin film 43.

In this embodiment, the housing 20 is movable with respect to the fixed placing table 40 by the pressing portion 30A. However, for example, by providing a pressing portion for the placing table 40, the placing table 40 can be moved with respect to the housing 20 while the housing 20 is fixed.

The pressing portion 30A is not particularly limited as long as the pressing portion 30A has the functions described in (1) and (2), and for example, a hydraulic or pneumatic cylinder may be employed. Otherwise, the pressing portion 30A may be a motor with a linear guide or the like. As described above, while causing the substrate B to be interposed between the solid electrolyte membrane 13 and the thin film 43 and pressing the substrate B against the solid electrolyte membrane 13 and the thin film 43 using the pressing portion 30A, a metal film can be formed.

2. Film Forming Method using Film Forming Apparatus 1A

Figure 1B:
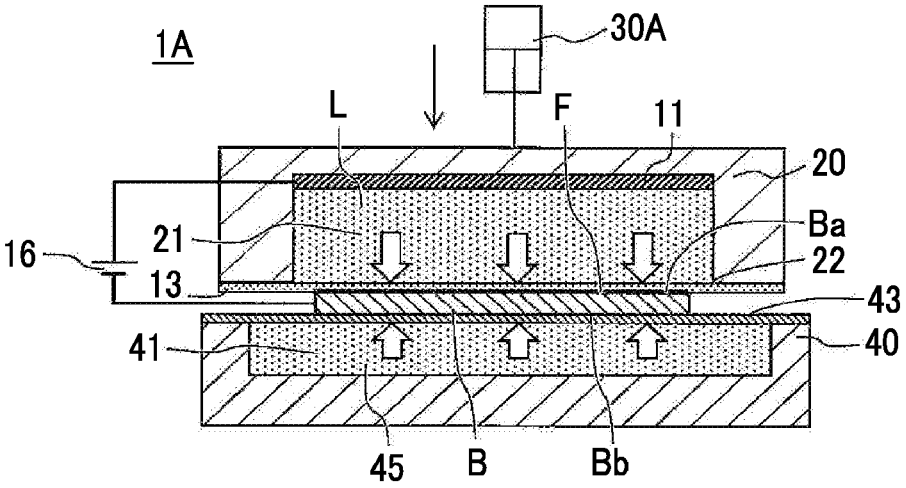
FIG. 1B is a view for explaining film formation of a metal film on a surface of a substrate using the film forming apparatus illustrated in FIG. 1A.

Hereinafter, a film forming method using the film forming apparatus 1A according to this embodiment will be described. FIG. 1B is a view for explaining film formation of a metal film F on the surface Ba of the substrate B using the film forming apparatus 1A illustrated in FIG. 1A.

First, as illustrated in FIG. 1A, the substrate B is disposed on the placing table 40 so that the surface Ba on which a metal film is to be formed faces the solid electrolyte membrane 13. Specifically, the substrate B is placed on the thin film 43 of the placing table 40 43 so that the entirety of the rear surface Bb of the substrate B is disposed on the fluid 45 accommodated in the second accommodation chamber 41 of the placing table 40 via the thin film 43.

As described above, the metal solution L is sealed in the first accommodation chamber 21 of the housing 20 with the solid electrolyte membrane 13 so that the metal solution L is disposed between the anode 11 and the solid electrolyte membrane 13. Furthermore, the fluid 45 is sealed in the second accommodation chamber 41 of the placing table 40 with the thin film 43 so that the fluid 45 is disposed on the rear surface Bb of the substrate B via the thin film 43. A metal film is formed on the surface Ba of the substrate B by using the housing 20 and the placing table 40 described above.

Specifically, as illustrated in FIG. 1B, in a state where the substrate B is placed on the placing table 40, the placing table 40 and the housing 20 are moved relative to each other so that the substrate B is interposed between the solid electrolyte membrane 13 and the thin film 43. Specifically, the housing 20 is lowered toward the placing table 40 by the pressing portion 30A to cause the metal solution L to be disposed on the surface Ba of the substrate B via the solid electrolyte membrane 13. More specifically, the part of the solid electrolyte membrane 13 positioned in the first opening 22 formed in the first accommodation chamber 21 is brought into contact with the surface Ba of the substrate B.

Furthermore, by pressurizing the substrate B from the solid electrolyte membrane 13 side by the pressing portion 30A, the solid electrolyte membrane 13 and the thin film 43 are pressed against the substrate B in the state of being interposed between the solid electrolyte membrane 13 and the thin film 43. Accordingly, the solid electrolyte membrane 13 and the thin film 43 can conform to the surface Ba and the rear surface Bb of the substrate B. Here, if a pressure gauge (not illustrated) for measuring the pressure of the metal solution L is provided in the first accommodation chamber 21, the substrate B can be pressed at a predetermined pressure while checking the measured pressure.

In this state, a voltage is applied between the anode 11 and the substrate B by the power supply 16 to reduce the metal ions contained in the solid electrolyte membrane 13, thereby causing a metal derived from the metal ions to deposit on the surface Ba of the substrate B. Accordingly, the metal film F is formed on the surface Ba of the substrate B.

As described above, when the metal film F is formed, the solid electrolyte membrane 13 and the thin film 43 conform to the surface Ba and the rear surface Bb of the substrate B, the surface Ba of the substrate B is uniformly pressurized by the metal solution L via the solid electrolyte membrane 13, and the rear surface Bb of the substrate B is uniformly pressurized by the fluid 45 via the thin film 43. Accordingly, the solid electrolyte membrane 13 and the thin film 43 can be uniformly pressed against the substrate B without forming a gap from the surface Ba and the rear surface Bb of the substrate B. In this state, by applying a voltage between the anode 11 and the substrate B, the metal ions contained in the solid electrolyte membrane 13 are reduced, the metal derived from the metal ions is deposited on the surface Ba of the substrate B, and the metal film F having a uniform film thickness can be formed on the surface Ba of the substrate B.

Second Embodiment

Figure 2A:
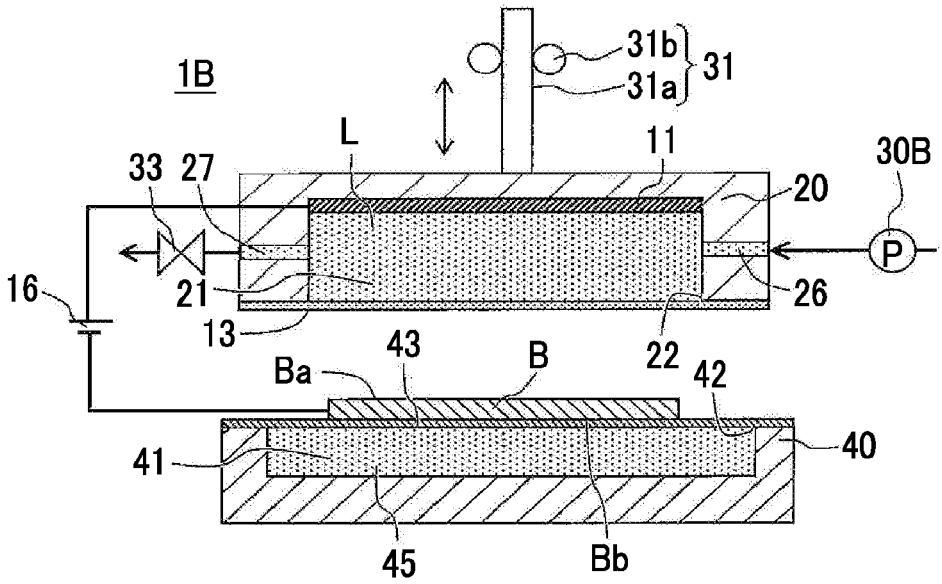
FIG. 2A is a schematic sectional view of a film forming apparatus for a metal film according to a second embodiment.

FIG. 2A is a schematic sectional view of a film forming apparatus 1B for a metal film according to a second embodiment of the present disclosure. The film forming apparatus 1B according to the second embodiment is different from the first embodiment in the configuration of the pressing portion. Therefore, in the second embodiment, like configurations similar to those of the film forming apparatus 1A of the first embodiment are denoted by like reference numerals, and the detailed description thereof will be omitted.

In this embodiment, instead of the pressing portion 30A described in the first embodiment, an elevating device 31 which raises and lowers the housing 20 is mounted. The elevating device 31 includes a guide 31*a* which is connected to the housing 20, and a roller 31*b* which is engaged with the guide 31*a* and is rotated to linearly move the guide 31*a*. In this embodiment, the solid electrolyte membrane 13 is not pressed against the surface Ba of the substrate B by using the elevating device 31.

In this embodiment, in the housing 20, a supply passage 26 through which the metal solution L is supplied to the first accommodation chamber 21 and a discharge passage 27 through which the metal solution L is discharged from the first accommodation chamber 21 are formed. A pump 30B corresponding to the pressing portion is connected to the supply passage 26 to pressurize the metal solution L in the first accommodation chamber 21, and a pressure regulating valve 33 which regulates the pressure of the metal solution L in the first accommodation chamber 21 is connected to the discharge passage 27.

In this embodiment, by driving the pump 30B, the metal solution L is pumped to the first accommodation chamber 21 through the supply passage 26 such that the pressure of the metal solution L in the first accommodation chamber 21 can be increased to a pressure set by the pressure regulating valve 33. The metal solution L in the first accommodation chamber 21 is discharged from the pressure regulating valve 33 so as not to exceed the set pressure, and the discharged metal solution L is supplied to the pump 30B such that the metal solution L is circulated through the film forming apparatus 1B.

Figure 2B:
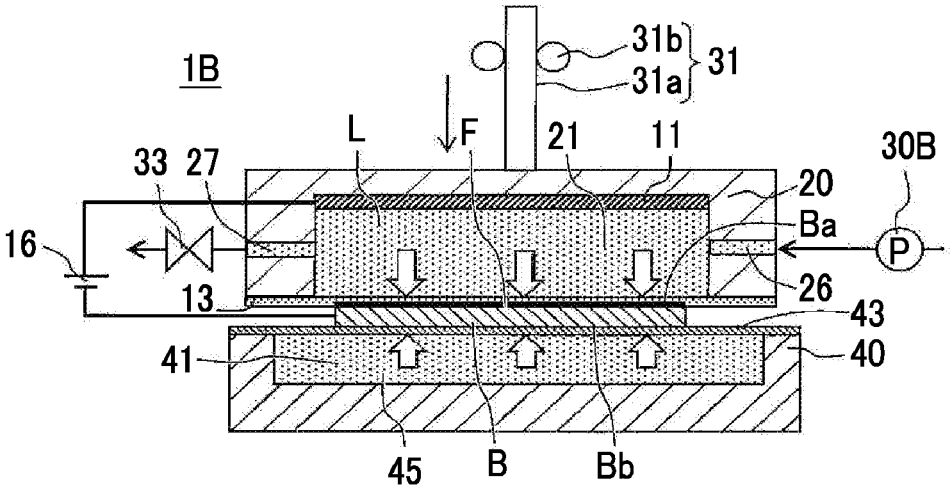
FIG. 2B is a view for explaining film formation of a metal film on the surface of the substrate using the film forming apparatus illustrated in FIG. 2A.

Hereinafter, a film forming method using the film forming apparatus 1B according to this embodiment will be described. FIG. 2B is a view for explaining film formation of the metal film F on the surface Ba of the substrate B using the film forming apparatus 1B illustrated in FIG. 2A. First, as in the first embodiment, the substrate B is placed on the placing table 40. Next, the housing 20 is lowered (moved) with respect to the placing table 40 by using the elevating device 31 to cause the substrate B to be interposed between the solid electrolyte membrane 13 and the thin film 43. In this state, by stopping the rotation of the roller 31*b*, the position of the guide 31*a* is fixed and the position of the housing 20 with respect to the placing table 40 is fixed.

Next, in the fixed state, the pump 30B is driven. Accordingly, the pressure of the metal solution L in the first accommodation chamber 21 increases such that a pressing force to press the solid electrolyte membrane 13 against the surface Ba of the substrate B is generated. Accordingly, on the rear surface Bb side of the substrate B, the reaction force due to the pressing force acts as a pressing force to press the thin film 43 against the rear surface Bb of the substrate B. As described above, by pressing the solid electrolyte membrane 13 and the thin film 43 against the substrate B, the solid electrolyte membrane 13 and the thin film 43 are caused to conform to the surface Ba and the rear surface Bb of the substrate B and the metal film F can be formed. In this embodiment, since the pressing of the solid electrolyte membrane 13 and the thin film 43 is adjusted by the liquid pressure of the metal solution L in the first accommodation chamber 21, the surface Ba and the rear surface Bb of the substrate B can be simply pressed at a desired pressure.

In addition, in this embodiment, the pump 30B for pressurizing the metal solution L in the first accommodation chamber 21 is provided, and the solid electrolyte membrane 13 and the thin film 43 are pressed by increasing the pressure of the metal solution L in the first accommodation chamber 21 by the pump 30B. Alternatively, for example, a pump for pressurizing the fluid 45 in the second accommodation chamber 41 is provided, and the solid electrolyte membrane 13 and the thin film 43 may be pressed by increasing the pressure of the fluid 45 in the second accommodation chamber 41 by the pump. Furthermore, the pressure of the metal solution L or the fluid 45 may be increased by connecting the above-described pump to both the first accommodation chamber 21 and the second accommodation chamber 41.

Third Embodiment

Figure 3A:
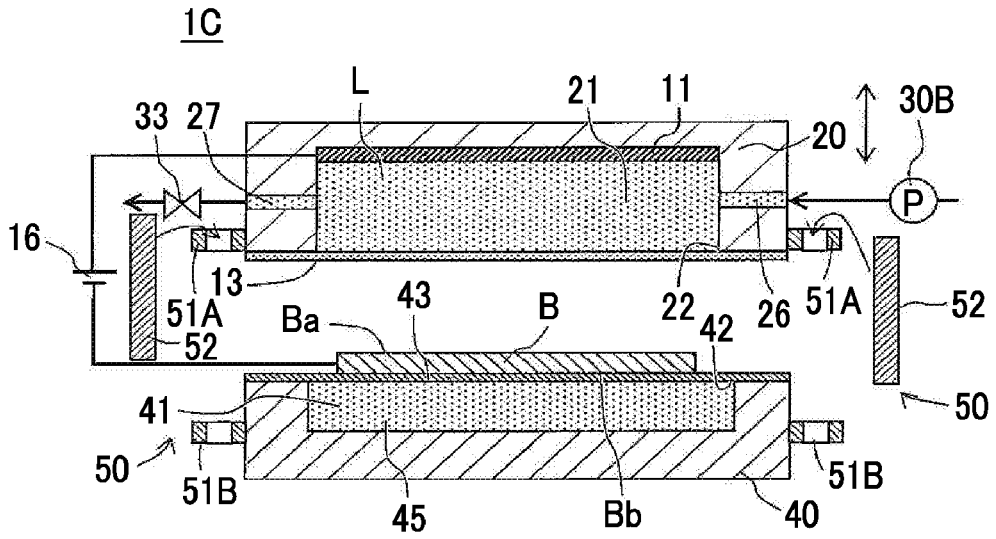
FIG. 3A is a schematic sectional view of a film forming apparatus for a metal film according to a third embodiment.

FIG. 3A is a schematic sectional view of a film forming apparatus 1C for a metal film according to a third embodiment of the present disclosure. The film forming apparatus 1C according to the third embodiment is different from the second embodiment in that a restricting section 50 is newly provided instead of the elevating device 31. Therefore, in the third embodiment, like configurations similar to those of the film forming apparatus 1B of the second embodiment are denoted by like reference numerals, and the detailed description thereof will be omitted.

In this embodiment, the restricting section 50 which restricts relative displacement between the housing 20 and the placing table 40 in the state in which the substrate B is interposed between the solid electrolyte membrane 13 and the thin film 43 is further provided. Specifically, the restricting section 50 is constituted by female threaded portions 51A and 51B attached to the side surfaces of the housing 20 and the placing table 40, and male threaded portions 52 screwed to the female threaded portions 51A and 51B. The restricting section 50 can restrict the relative displacement between the housing 20 and the placing table 40 by fastening the male threaded portions 52 to the female threaded portions 51A and 51B.

Figure 3B:
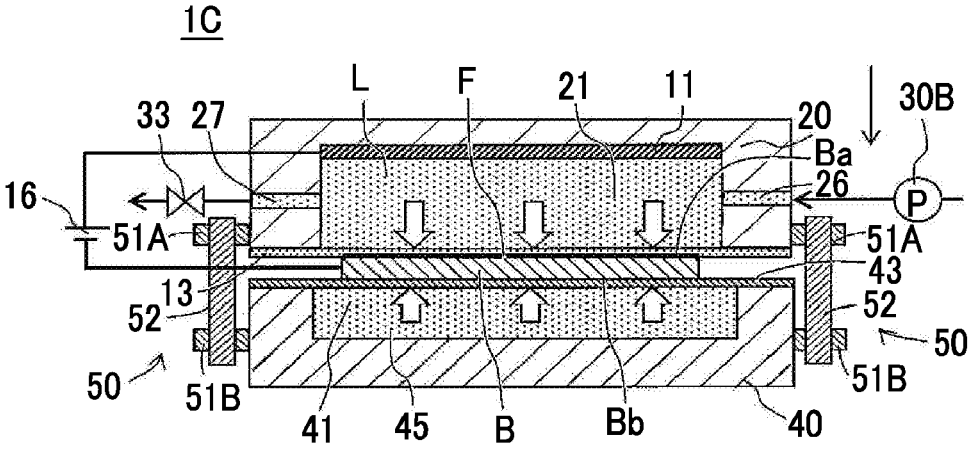
FIG. 3B is a view for explaining film formation of a metal film on the surface of the substrate using the film forming apparatus illustrated in FIG. 3A.

Hereinafter, a film forming method using the film forming apparatus 1C according to this embodiment will be described. FIG. 3B is a view for explaining film formation of the metal film F on the surface Ba of the substrate B using the film forming apparatus 1C illustrated in FIG. 3A. First, as in the second embodiment, the substrate B is placed on the placing table 40. Next, the housing 20 is moved (lowered) toward the placing table 40 to cause the substrate B to be interposed between the solid electrolyte membrane 13 and the thin film 43.

By fastening the male threaded portions 52 to the female threaded portions 51A and 51B in the state in which the substrate B is interposed between the solid electrolyte membrane 13 and the thin film 43, the relative displacement between the housing 20 and the placing table 40 is restricted by the restricting section 50, and the pump 30B is driven in this state.

Accordingly, the pressure of the metal solution L in the first accommodation chamber 21 increases such that a pressing force to press the solid electrolyte membrane 13 against the surface Ba of the substrate B is generated. Accordingly, on the rear surface Bb side of the substrate B, the reaction force due to the pressing force acts as a pressing force to press the thin film 43 against the rear surface Bb of the substrate B. Since the relative displacement between the housing 20 and the placing table 40 is restricted by the restricting section 50, the housing 20 is not pushed back by the reaction force, and thus the solid electrolyte membrane 13 and the thin film 43 can be uniformly pressed against the substrate B by the liquid pressure of the metal solution L. Accordingly, the solid electrolyte membrane 13 and the thin film 43 are caused to uniformly conform to the surface Ba and the rear surface Bb of the substrate B and the metal film F can be formed.

Furthermore, in this embodiment, unlike the first and second embodiments, the metal film can be formed without the use of the pressing portion 30A and the elevating device 31 formed of a cylinder, and a compact size can be achieved by the film forming apparatus 1C.

Fourth Embodiment

Figure 4A:
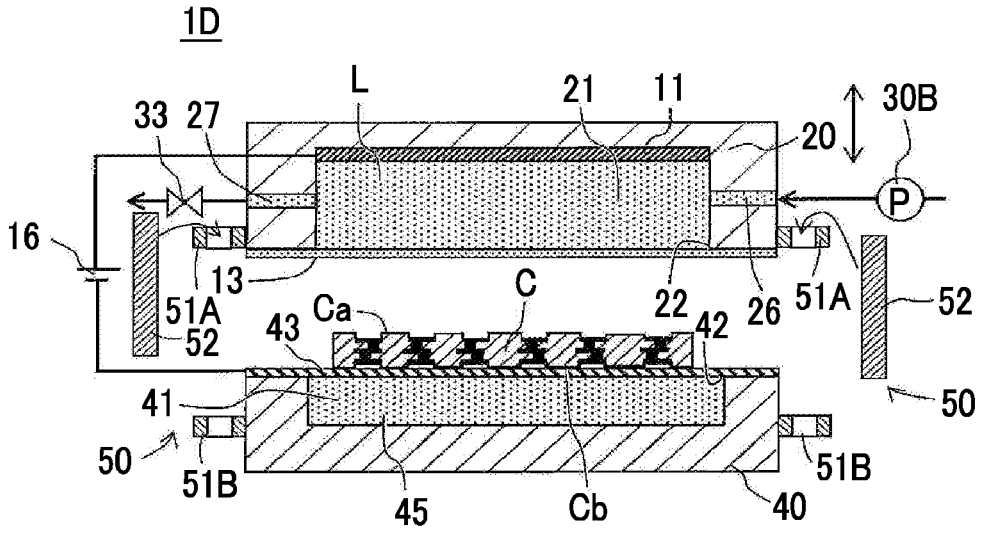
FIG. 4A is a schematic sectional view of a film forming apparatus for a metal film according to a fourth embodiment.
Figure 4B:
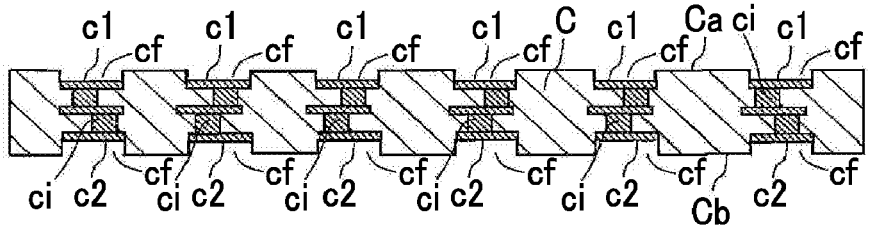
FIG. 4B is a schematic sectional view of a substrate formed in the fourth embodiment.

FIG. 4A is a schematic sectional view of a film forming apparatus 1D for a metal film according to a fourth embodiment of the present disclosure. FIG. 4B is a schematic sectional view of a substrate C formed in the fourth embodiment. In the fourth embodiment, the substrate to be formed is different from that of the third embodiment, and the material of the thin film is different. Therefore, in the fourth embodiment, like configurations similar to those of the film forming apparatus 1C of the third embodiment are denoted by like reference numerals, and the detailed description thereof will be omitted.

As illustrated in FIG. 4B, the substrate C according to this embodiment is a build-up substrate in which an insulating material and a conductor material are laminated, a plurality of first conductor portions c1 on which a metal film is to be formed are formed separately from each other on a surface Ca of the substrate C which is made of an insulating resin. Furthermore, second conductor portions c2 which are electrically connected to the respective first conductor portions c1 through inner conductors ci of the substrate C are formed on a rear surface Cb of the substrate C which is made of an insulating resin. Specifically, recesses cf are formed on the surface Ca and the rear surface Cb of the substrate C, and the first conductor portions c1 and the second conductor portions c2 are formed at the bottom surfaces of the recesses cf.

Furthermore, in the film forming apparatus 1D according to this embodiment, the thin film 43 is a thin film made of a metal such as aluminum. The thin film 43 is connected to the negative electrode of the power supply 16 via the placing table 40 made of a metal. In addition, in this embodiment, since the thin film 43 is a thin film made of a metal, it is preferable that the fluid 45 is a liquid or a gel having conductivity. Accordingly, during film formation, current from the power supply 16 can be caused to uniformly flow through the thin film 43 via the fluid 45.

Figure 4C:
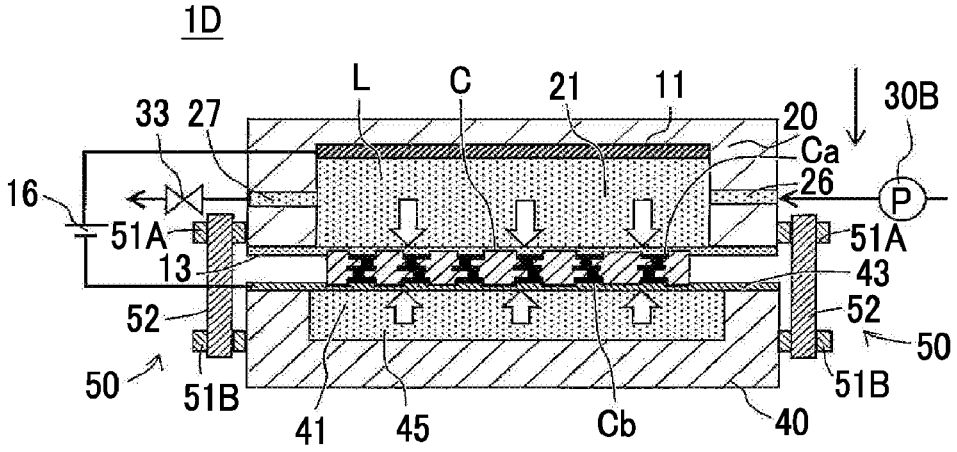
FIG. 4C is a view for explaining film formation of a metal film on a surface of the substrate using the film forming apparatus illustrated in FIG. 4A.
Figure 4D:
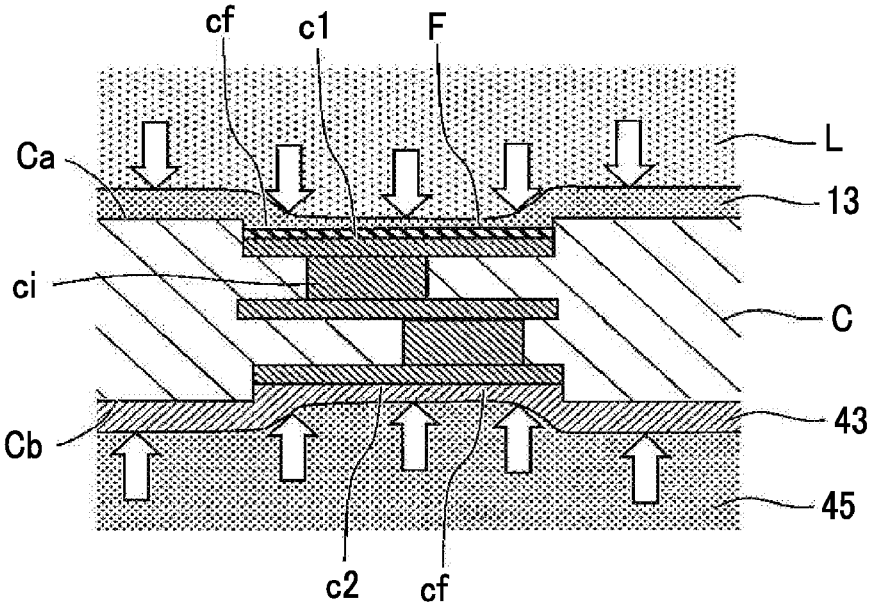
FIG. 4D is a partial enlarged view of the vicinity of the surface and a rear surface of the substrate illustrated in FIG. 4C during the film formation of the metal film.

Hereinafter, a film forming method using the film forming apparatus 1D according to this embodiment will be described. FIG. 4C is a view for explaining film formation of a metal film on the surface Ca of the substrate C using the film forming apparatus 1D illustrated in FIG. 4A, and FIG. 4D is a partial enlarged view of the vicinity of the surface Ca and the rear surface Cb of the substrate C illustrated in FIG. 4C during the film formation of the metal film.

First, as in the third embodiment, the substrate C is placed on the placing table 40. Next, the housing 20 is moved toward the placing table 40 to cause the substrate C to be interposed between the solid electrolyte membrane 13 and the thin film 43.

In the state in which the substrate C is interposed between the solid electrolyte membrane 13 and the thin film 43, the relative displacement between the housing 20 and the placing table 40 is restricted by the restricting section 50. In this state, the pump 30B is driven. Accordingly, the pressure of the metal solution L in the first accommodation chamber 21 increases such that a pressing force to press the solid electrolyte membrane 13 against the surface Ca of the substrate C is generated. Accordingly, on the rear surface Cb side of the substrate C, the reaction force due to the pressing force acts as a pressing force to press the thin film 43 against the rear surface Cb of the substrate C.

As described above, as illustrated in FIG. 4D, the solid electrolyte membrane 13 conforms to the surface Ca on which the recesses cf are formed and comes into contact with the first conductor portions c1. On the other hand, the thin film 43 conforms to the rear surface Cb on which the recesses cf are formed and comes into contact with the second conductor portions c2. The thin film 43 is a thin film made of a metal, and the second conductor portions c2 that come into contact with the thin film 43 are electrically connected to the first conductor portions c1 through the inner conductors ci.

Here, the plurality of first conductor portions c1 of the substrate C are disposed separately from each other on the surface Ca of the substrate C, and each of the first conductor portions c1 is positioned at the bottom surface of the recess cf formed on the surface Ca. Therefore, it is difficult to directly connect the negative electrode of the power supply 16 to each of the first conductor portions c1 by using a conductor jig or the like. However, according to this embodiment, without the use of the conductor jig, by causing the thin film 43 to conform to the rear surface Cb on which the recesses cf are formed, the negative electrode of the power supply 16 can simply be electrically connected to the plurality of first conductor portions c1 from the rear surface Cb side of the substrate C. Therefore, the metal film can be simply formed on the first conductor portions c1 of the substrate C. Particularly, as in this embodiment, even if the second conductor portions c2 are formed at the bottom surfaces of the recesses cf formed on the rear surface Cb of the substrate C, by causing the thin film 43 to conform to the rear surface Cb, the thin film 43 can be simply brought into contact with the second conductor portions c2.

In this embodiment, the thin film 43 is a metal thin film. However, for example, if the surface on which the substrate C is placed is a thin film having conductivity, by bringing the thin film 43 into contact with the first conductor portions c1, the negative electrode of the power supply 16 can be electrically connected to the first conductor portions c1 via the thin film 43. Therefore, the thin film 43 may be a thin film in which a resin layer and a metal layer are laminated as long as the surface on which the substrate C is placed has conductivity. For example, the thin film 43 may be a thin film in which a filler having conductivity is contained in a resin.

Figure 4E:
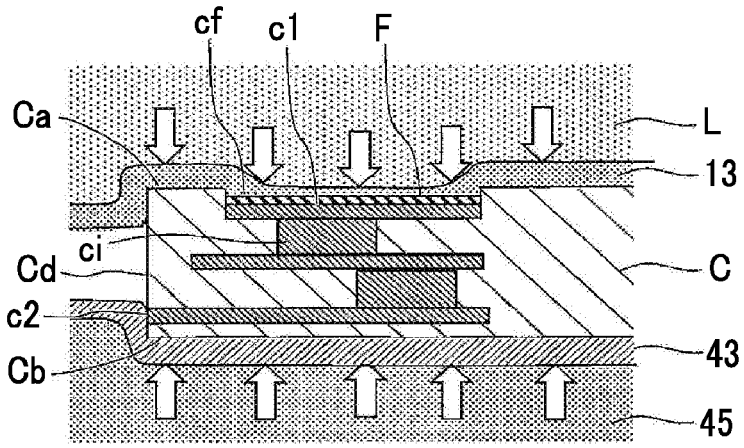
FIG. 4E is a partial enlarged view of the vicinity of a side surface of the substrate during the film formation of the metal film according to a modification example corresponding to FIG. 4D.

Furthermore, in the substrate C of this embodiment, the second conductor portions c2 electrically connected to the first conductor portions c1 through the inner conductors ci are formed on the rear surface Cb of the substrate C. However, for example, as illustrated in FIG. 4E the second conductor portion c2 which are electrically connected to the first conductor portions c1 through the inner conductors ci may be formed on a side surface Cd of the substrate C. Even in this case, when the second conductor portions c2 are brought into contact with the thin film 43 by causing the thin film 43 to conform to the rear surface Cb of the substrate C and a part of the side surface Cd thereof during pressing, the negative electrode of the power supply 16 can simply to electrically connected to the plurality of first conductor portions c1 from the side surface side of the substrate C.

The present disclosure will be described with reference to the following examples. [Example 1] A metal film was formed using the film forming apparatus 1D illustrated in FIG. 4A described above. First, as the substrate, a glass epoxy substrate in which glass fibers are impregnated with an epoxy resin was prepared. The dimensions of the glass epoxy substrate were 40 mm×50 mm×0.8 mm. A resist having a thickness of 20 μm was formed on the surface of the substrate, and 16 copper lands (first conductor portions) having a diameter of 0.6 mm were formed on the surface exposed from the resist. Specifically, the copper lands are formed at the bottom surfaces of the recesses on the surface of the substrate formed by the resist. Furthermore, as illustrated in FIG. 4B, a plurality of recesses are formed on the rear surface of the substrate made of the glass epoxy resin, and second conductor portions which are electrically connected to the respective copper lands are formed at the bottom surfaces of the recesses.

Next, as the metal solution, a 1.0 mol/L copper sulfate aqueous solution was prepared and accommodated in a first accommodation chamber. A mesh made of oxygen-free copper was used as the anode, and a fluororesin-based solid electrolyte membrane (NAFION N117 (registered trademark) manufactured by DuPont) having a film thickness of 50 μm was used as the solid electrolyte membrane. A polystyrene gel (modulus of elasticity: about 5 MPa) was used as the fluid accommodated in the second accommodation chamber of the placing table, and an aluminum thin film was used as the thin film.

By driving the pump in a state in which the substrate was interposed between the solid electrolyte membrane and the thin film, the pressure inside the first accommodation chamber was set to 1.0 MPa. Accordingly, while the solid electrolyte membrane was pressed against the surface of the substrate at 1.0 MPa, a voltage was applied between the anode and the placing table for 40 minutes to reach a current density of 50 $mA/cm^2$, and a copper film was formed on the surface of the copper land of the substrate.

Comparative Example 1

In the same manner as in Example 1, a copper film was formed on the substrate.

The difference from Example 1 is that the anode in the first accommodation chamber is brought into contact with the solid electrolyte membrane by using the film forming apparatus 1A illustrated in FIG. 1A to cause the anode to be pressed (pressurized) against the substrate via the solid electrolyte membrane, and a titanium plate was disposed in the second accommodation chamber of the placing table of the film forming apparatus without providing a thin film.

Comparative Example 2

In the same manner as in Example 1, a copper film was formed on the substrate. The difference from Example 1 is that the anode in the first accommodation chamber is brought into contact with the solid electrolyte membrane by using the film forming apparatus 1A illustrated in FIG. 1A to cause the anode to be pressed (pressurized) against the substrate via the solid electrolyte membrane.

Comparative Example 3

In the same manner as in Example 1, a copper film was formed on the substrate. The difference from Example 1 is that a titanium plate was disposed in the second accommodation chamber of the placing table of the film forming apparatus without providing a thin film.

Comparative Example 4

In the same manner as in Example 1, a copper film was formed on the substrate. The difference from Example 1 is that a conductive silicone rubber was disposed in the second accommodation chamber of the placing table of the film forming apparatus without providing a thin film.

Reference Examples 1 and 2

In the same manner as in Example 1, a copper film was formed on the substrate. The difference from Example 1 is that the liquid pressure of the metal solution was set to 0.1 MPa and 0.5 MPa during film formation by adjusting the set pressure of the pressure regulating valve.

The film forming conditions of Example 1, Comparative Examples 1 to 4, and Reference Examples 1 and 2 and the number of copper lands on which a copper film was formed are shown in Table 1 below.

TABLE 1

| | Pressurization type | Pressurizing force (MPa) | Second accommodation chamber | Number (pieces) |
|---|---|---|---|---|
| Example 1 | Liquid pressure | 1.0 | Gel + thin film | 16 |
| Comparative Example 1 | Anode pressurization | 1.0 | Titanium plate | 0 |
| Comparative Example 2 | Anode pressurization | 1.0 | Gel + thin film | 0 |
| Comparative Example 3 | Liquid pressure | 1.0 | Titanium plate | 0 |
| Comparative Example 4 | Liquid pressure | 1.0 | Rubber | 14 |
| Reference Example 1 | Liquid pressure | 0.1 | Gel + thin film | 8 |
| Reference Example 2 | Liquid pressure | 0.5 | Gel + thin film | 14 |

<Results and Discussion>

In Example 1, a copper film was formed on all the copper lands. However, in Comparative Examples 1 to 3, no copper film was formed on the copper lands, and in Comparative Example 4 and Reference Examples 1 and 2, the copper lands with no copper film formed thereon were present.

In Example 1, it is thought that during film formation, by causing the solid electrolyte membrane to conform to the surface of the substrate by the liquid pressure generated on the first accommodation chamber side, the solid electrolyte membrane was in contact with all the first conductor portions of the substrate. In addition to this, it is thought that on the rear surface side of the substrate, the gel in the second accommodation chamber had deformed (flowed) due to the reaction force of the liquid pressure on the first accommodation chamber side such that the thin film conformed to the rear surface of the substrate and the thin film was in contact with all the second conductor portions of the substrate. Accordingly, it is thought that the copper film was formed on all the copper lands in Example 1.

On the other hand, it is thought that in Comparative Examples 1 and 2, since the solid electrolyte membrane pressed the surface of the substrate by the pressure from the anode in contact with the solid electrolyte membrane during film formation, the solid electrolyte membrane did not conform to the surface of the substrate and the solid electrolyte membrane was not in contact with all the first conductor portions of the substrate. Accordingly, it is thought that no copper film was formed on all the copper lands in Comparative Examples 1 and 2.

Furthermore, it is thought that in Comparative Example 3, since the titanium plate was not deformed by the reaction force of the liquid pressure on the first accommodation chamber side on the rear surface side of the substrate, the thin film did not conform to the rear surface of the substrate and the thin film was not in contact with the second conductor portions of the substrate. Accordingly, it is thought that no copper film was formed on all the copper lands in Comparative Example 3.

In Comparative Example 4, although the silicone rubber was deformed by the reaction force of the liquid pressure on the first accommodation chamber side on the rear surface side of the substrate, the silicone rubber is not a fluid, the silicone rubber is less likely to deform than the polystyrene gel. Accordingly, it is thought that the thin film did not perfectly conform to the rear surface of the substrate and the thin film was not in contact with a part of the second conductor portions of the substrate. Accordingly, it is thought that in Comparative Example 4, a copper film was not formed on a part of the copper lands.

In Reference Examples 1 and 2, it is thought that since the liquid pressure of the metal solution was low, on the rear surface side of the substrate, the flow of the gel in the second accommodation chamber was insufficient due to the reaction force of the liquid pressure on the first accommodation chamber side, the thin film did not perfectly conform to the rear surface of the substrate, and the thin film was not in contact with a part of the second conductor portions of the substrate. Accordingly, it is thought that in Reference Examples 1 and 2, a copper film was not formed on a part of the copper lands.

While the embodiments of the present disclosure have been described above in detail, the present disclosure is not limited to the above-described embodiments, and various changes in design may be made without departing from the spirit of the present disclosure described in the appended claims.

What is claimed is:

1. A film forming apparatus for a metal film comprising:

an anode;

a solid electrolyte membrane which is disposed between the anode and a substrate which is a cathode, and contains metal ions;

a power supply which applies a voltage between the anode and the substrate;

a housing having a first accommodation chamber which accommodates a metal solution containing metal ions;

a placing table on which the substrate is placed and which has a second accommodation chamber that accommodates a fluid;

a thin film having flexibility; and a pressing portion which presses the solid electrolyte membrane and the thin film against the substrate in a state of being interposed between the solid electrolyte membrane and the thin film, wherein the metal solution is disposed between the anode and the solid electrolyte membrane, and the metal solution is sealed in the first accommodation chamber with the solid electrolyte membrane so as to cause the metal solution to be disposed on a surface of the substrate via the solid electrolyte membrane, the fluid is sealed in the second accommodation chamber with the thin film so as to cause the fluid to be disposed on a rear surface of the substrate positioned on a side opposite to the surface on which the metal film is formed, via the thin film, at least one of the housing and the placing table is movable to cause the substrate to be interposed between the solid electrolyte membrane and the thin film, and the thin film is a thin film in which a surface on which the substrate is placed has conductivity.

2. The film forming apparatus according to claim 1, wherein the pressing portion is a pump which pressurizes the metal solution in the first accommodation chamber or a pump which pressurizes the fluid in the second accommodation chamber.

3. The film forming apparatus according to claim 2, further comprising:

a restricting section which restricts relative displacement between the housing and the placing table in the state in which the substrate is interposed between the solid electrolyte membrane and the thin film.

* * * * *